US007033669B2

(12) United States Patent
Skidds

(10) Patent No.: US 7,033,669 B2
(45) Date of Patent: Apr. 25, 2006

(54) CATIONICALLY DYED FIBERS AND ARTICLES CONTAINING THE SAME

(76) Inventor: Ronald O. Skidds, 357 Golf View Dr., Cohutta, GA (US) 30710

( * ) Notice: Subject to any disclaimer, the term of this patent is extended or adjusted under 35 U.S.C. 154(b) by 0 days.

(21) Appl. No.: 10/360,669

(22) Filed: Feb. 7, 2003

(65) Prior Publication Data

US 2003/0152770 A1 Aug. 14, 2003

Related U.S. Application Data

(60) Provisional application No. 60/359,824, filed on Feb. 27, 2002, provisional application No. 60/356,943, filed on Feb. 13, 2002.

(51) Int. Cl.
*D02G 3/00* (2006.01)

(52) U.S. Cl. ..... 428/373; 428/364; 428/374; 8/529; 8/531

(58) Field of Classification Search ..... 428/375, 428/373, 374, 364; 8/529, 531
See application file for complete search history.

(56) References Cited

U.S. PATENT DOCUMENTS

| | | | | |
|---|---|---|---|---|
| 2,939,201 | A | 6/1960 | Holland | 28/82 |
| 2,939,202 | A | 6/1960 | Holland | 28/82 |
| 2,989,798 | A | 6/1961 | Bannerman | 28/82 |
| 3,161,608 | A * | 12/1964 | Caldwell et al. | 524/37 |
| 3,184,436 | A * | 5/1965 | Magat | 528/321 |
| 3,616,183 | A | 10/1971 | Brayford et al. | 161/175 |
| 3,645,819 | A | 2/1972 | Fujii et al. | 156/148 |
| 3,676,050 | A * | 7/1972 | James | 8/598 |
| 3,679,541 | A | 7/1972 | Davis et al. | 161/175 |
| 3,828,009 | A * | 8/1974 | Lofquist | 528/321 |
| 3,898,200 | A * | 8/1975 | Lofquist | 528/321 |
| 4,075,378 | A | 2/1978 | Anton et al. | 428/97 |
| 5,092,905 | A * | 3/1992 | Dore | 8/638 |
| 5,162,074 | A | 11/1992 | Hills | 156/644 |
| 5,344,299 | A | 9/1994 | Takeuchi | 425/142 |
| 5,445,884 | A | 8/1995 | Hoyt et al. | 428/370 |
| 6,132,839 | A | 10/2000 | Reader | 428/97 |
| 2001/0007706 | A1* | 7/2001 | Hoyt et al. | 428/97 |
| 2003/0104163 | A1* | 6/2003 | Hoyt et al. | 428/92 |
| 2004/0131822 | A1* | 7/2004 | Hoyt et al. | 428/97 |

FOREIGN PATENT DOCUMENTS

| | | | |
|---|---|---|---|
| EP | 0982415 | A | 3/2000 |
| EP | 1254975 | A | 11/2002 |
| WO | WO 9811283 | A | 3/1998 |

* cited by examiner

*Primary Examiner*—J. M. Gray
(74) *Attorney, Agent, or Firm*—Nixon & Vanderhye, PC

(57) ABSTRACT

Dyed sheath/core polyamide-containing fibers are disclosed. Further, methods of making dyed sheath/core polyamide-containing fibers are disclosed. Articles containing dyed sheath/core polyamide-containing fibers are also disclosed.

28 Claims, No Drawings

CATIONICALLY DYED FIBERS AND ARTICLES CONTAINING THE SAME

CROSS-REFERENCE TO RELATED APPLICATIONS

This patent application claims the benefit of priority to U.S. provisional patent application Ser. No. 60/356,943, filed on Feb. 13, 2002, and U.S. provisional patent application Ser. No. 60/359,824, filed on Feb. 27, 2002.

FIELD OF THE INVENTION

The present invention relates to dyed fibers and methods of making such fibers. The present invention further relates to articles of manufacture containing dyed fibers.

BACKGROUND OF THE INVENTION

Polyamide fibers are relatively inexpensive and offer a combination of desirable qualities such as comfort, warmth and ease of manufacture into a broad range of colors, patterns and textures. As a result, polyamide fibers are widely used in a variety of household and commercial articles, including, e.g., carpets, drapery material, upholstery and clothing. Carpets made from polyamide fibers are a popular floor covering for both residential and commercial applications.

Sheath/core bi-component polyamide-containing fibers are known. U.S. Pat. No. 4,075,378 to Anton discloses sheath/core bi-component polyamide fibers containing a polyamide core and a polyamide sheath. The core polyamide is acid-dyeable while the sheath polyamide is basic-dyeable due to sulfonation. Other patents disclosing sheath/core and/or other types of bicomponent fibers include U.S. Pat. No. 5,445,884 to Hoyt et al.; U.S. Pat. No. 3,679,541 to Davis et al.; U.S. Pat. No. 3,645,819 to Fujii et al.; U.S. Pat. No. 3,616,183 to Brayford; and U.S. Pat. No. 2,989,798 to Bannerman.

Fibers that are non-round in transverse cross-section are also known. For example, U.S. Pat. Nos. 2,939,202 and 2,939,201, both to Holland, describe fibers having a trilobal cross-section.

Polyamide fibers may be dyed to produce a variety of colors suitable for use in a number of textiles, including, but not limited to, fabrics and carpets. Uniform or level dyeing of polyamide fibers has been a problem that has received much attention over the years. Combinations of specific dyes and fibers have been used in an effort to improve dyeing uniformity or levelness of a given fiber, fabric, or carpet. Although some improvements have been made, further improvements in dyeing uniformity are desired by those in the textile industry, in particular the carpet industry.

What is needed in the art is a dyed polyamide fiber, which possesses superior dyeing properties, including an improved uniformity or levelness of dyeing. What is also needed in the art is a method of making a polyamide fiber having superior dyeing uniformity or levelness.

SUMMARY OF THE INVENTION

The present invention addresses some of the difficulties and problems discussed above by the discovery of a novel dyed polyamide fiber. The polyamide fiber may be dyed using one or more specific cationic dyes to produce a superior uniformity or levelness of dyeing.

The present invention is further directed to a method of dyeing a polyamide fiber. In one embodiment of the present invention, the dyed polyamide fiber is prepared by contacting the polyamide fiber with at least one cationic dye. The polyamide fiber may be dyed as a fiber, or after being incorporated into a fabric or carpet.

The present invention is even further directed to articles of manufacture comprising a textile containing a plurality of dyed polyamide fibers either alone or in combination with other fibers. In one embodiment of the present invention, the article of manufacture comprises a carpet.

These and other features and advantages of the present invention will become apparent after a review of the following detailed description of the disclosed embodiments and the appended claims.

DETAILED DESCRIPTION OF THE INVENTION

The present invention is directed to a novel dyed polyamide fiber having improved uniformity or levelness of dyeing, as well as, colorfastness. The dyed polyamide fiber comprises a core fiber portion, a sheath fiber portion, and one or more cationic dyes chemically bonded to the core fiber portion. A description of terns used herein to describe the present invention is given below.

As used herein, "dyed" refers to the results of an intentional coloration process performed by exhaust or continuous dyeing methods that are known in the art, wherein one or more colored chemical compounds (i.e., dyes) are chemically bonded to a material (e.g., a fiber) at elevated temperature.

As used herein, "owf" refers to "on the weight of the fiber" and is used to describe the amount of a given dye used to dye a given fiber. For example, 0.005% owf of dye A means that an amount of dye A equal to 0.005 percent of the total weight of fiber being dyed is used to dye the fiber.

As used herein, "uniformity" or "levelness" of dyes or dyeing refers to the degree and consistency of dye coverage of a fiber or fabric. Characteristics of a uniformly or level dyed fiber include continuous coverage of the fiber with the dye or dye combination, and absent dyeing defects, such as blotchiness and fiber-to-fiber color variation.

As used herein, the terms "sheath" and "core" refer to the structural components of a bicomponent fiber, wherein the sheath component forms an outer cover over at least a portion of a core component of the fiber. Typically, the sheath covers the entire core component of the fiber.

As used herein, the terms "cationic dye" and "cationic dyes" refer to a basic dye and basic dyes respectively.

The polyamide fiber components and suitable cationic dyes for use in the present invention are described in detail below.

1. The Polyamide Fiber

The polyamide fiber of the present invention has a sheath/core fiber configuration, wherein at least a portion of a core component of the fiber is covered by a sheath component. Desirably, the polyamide fiber of the present invention contains from about 97% by weight to about 10% by weight of a core portion, and from about 3% by weight to about 90% by weight of a sheath portion. More desirably, the polyamide fiber of the present invention contains from about 97% by weight to about 70% by weight of a core portion, and from about 3% by weight to about 30% by weight of a sheath portion. Even more desirably, the fiber contains from about 97% by weight to about 85% by weight of the core portion and from about 3% by weight to about 15% by weight of the sheath portion. Even more desirably, the fiber contains from about 97% by weight to 90% by weight of the core portion and about 3% by weight to less than 10% by weight of the sheath portion.

A. The Core Fiber Component

The core may be formed from any fiber-forming polyamide or copolyamide. Fiber-forming polyamides suitable for use in the core include, but are not limited to, polymers having, as an integral part of the polymer backbone chain, recurring amide groups (—CO—NR—) where R is an alkyl, aryl, alkenyl, or alkynyl moiety, which may be further substituted with groups including, but not limited to, sulfonato groups. Non-limiting examples of such polyamides include, but are not limited to, homopolyamides and copolyamides, which are obtained by the polymerization of lactam or aminocaproic acid or a copolymerization product from any of the possible permutative mixtures of diamines, dicarboxylic acids or lactams.

The core may be a basic-dyeable polyamide, such as made when polyamide forming monomers are polymerized in the presence of anionic groups such as sulfonated monomers. Such polyamides and methods of forming the same are well known to those of ordinary skill in the art and are generally among the class of polyamides having 15 or less carbon atoms in a repeating unit (or monomer in the case of mixed monomer starting materials). More desirably, the polyamide will have less than seven carbon atoms in the repeating unit such as in nylon 6 and nylon 6/6. Other polyamides such as nylon 12, nylon 11, nylon 6/12, nylon 6/10, etc., may be used as long as the polyamide is basic-dyeable polyamide. Even more desirably, the core polyamide is nylon 6 or nylon 6/6.

The basic-dyeable core polyamide may also be acid-dyeable. The core polyamide may desirably have an amine end-group content of from greater than about 5 milliequivalents per kilogram (meq/kg) to less than about 100 milliequivalents per kilogram, more desirably from about 20 to about 50 milliequivalents per kilogram.

B. The Sheath Fiber Component

The sheath portion of the fiber comprises a non-dyeable fiber-forming polymer that resists dye migration at room temperature, relative to nylon 6. Suitable polymers include, but are not limited to, polyolefins (e.g., polypropylene, polybutylene, etc.), fiber-forming polystyrene, fiber-forming polyurethane, and certain polyamides. Desirably, the sheath comprises a polymer that is inherently chemically compatible with the core polymer and is non-dyeable. More desirably, the sheath is a polyamide polymer selected from the group consisting of polyamides having the structure:

$$[—NH—(CH_2)_x—NH—C(O)—(CH_2)_y—C(O)—]_n \quad (a)$$

wherein x and y may be the same or different integers, desirably from about 4 to about 30 and the sum of x and y is greater than about 8, more desirably the sum of x and y is from about 9 to about 20, and even more desirably the sum of x and y is from about 9 to about 18; and n is desirably greater than about 40;

$$[—NH—(CH_2)_z—C(O)—]_m \quad (b)$$

where z is an integer, desirably from about 9 to about 30, more desirably from about 9 to about 20, and even more desirably from about 9 to about 15; and m is desirably greater than about 40;

(c) derivatives of (a) or (b) including polymers substituted with one or more sulfonate, halogenate, aliphatic or aromatic functionality; and (d) copolymers and blends of (a), (b) and (c).

Desirably, the polymers have greater than about 80% of the non-carbonyl backbone or substituent carbons as alkyl, alkenyl, alkynyl, aryl, fluoroalkyl, fluoroalkenyl, fluoroalkynyl, fluoroaryl, chloroalkyl, chloroalkenyl, chloroalkynyl, chloroaryl, and the like, and do not have polar substituents such as hydroxy, amino, sulfoxyl, carboxyl, nitroxyl, or other such functionalities capable of hydrogen-bonding. Non-limiting examples of suitable fiber-forming polyamides, which can be used as the sheath polyamide include, but are not limited to, nylon 6/10, nylon 6/12, nylon 10, nylon 11 and nylon 12. The fiber-forming sheath polyamide may be sulfonated, but is desirably substantially sulfonate-free. Even more desirably, the sheath polymer is nylon 6/12. Optionally, the sheath polyamide component may have a titratable amine-end-group concentration of less than about 30 meq/kg. If the polymers are amine-end-group blocked, useful amine-end-group-blocking agents include lactones, such as caprolactones and butyrolactones.

II. Methods of Making The Polyamide Fiber

The sheath of the fiber will desirably substantially or completely cover the core of the polyamide fiber. Methods for forming sheath/core fibers are known to those of ordinary skill in the art. One desired method of forming sheath/core fibers is described in U.S. Pat. No. 5,162,074 to Hills, which is hereby incorporated by reference in its entirety for the bicomponent spinning techniques taught therein. The sheath/core arrangement may be eccentric or concentric.

The fibers of the present invention are desirably multilobal. Trilobal cross-sections are more desired. Additionally, the fibers might contain one or more internal void spaces, for example, a central axial void.

The fibers used in the present invention may be continuous fibers or staple-length fibers, either alone or in admixture with other fibers. The fibers are particularly useful as bulked continuous filament yarns.

Common melt-spinning and after-processing techniques may be employed to make the fibers and provide desired properties to the fibers. The fibers may be textured to produce bulked yarns by known methods including stuffer-box crimping, gear-crimping, edge-crimping, false-twist texturing and hot-fluid jet bulking. Several ends may be combined in a variety of manners and twisted at levels according to conventional techniques, for example, groups of the fibers may be plied into yarn. The yarn may be cabled (i.e., plied and twisted). Desirably, the yarn is heat set.

It is especially desired and especially beneficial if the fibers used in the present invention are cabled and heat set. As those of ordinary skill in the art will recognize, "cabled" refers to yarn that is plied and twisted. Cabling and heatsetting can be accomplished according to any method conventionally used in the art. It is not believed that the method of cabling or heatsetting is essential to the benefit of the present invention.

Polyamide yarns may shrink during heatsetting. The yarns of the present invention may be heatset by any conventional method including, but not limited to, Superba heatsetting (i.e., steam heatsetting), autoclave heatsetting (i.e., steam heatsetting) and Suessen heatsetting (i.e., hot air heatsetting). Desirably, the polyamide yarns of the present invention have a steam heatsetting shrinkage value of about 70% or less relative to the steam heatsetting shrinkage value of yarn, which is manufactured in the identical manner but which consists only of the core polyamide component. Steam heatsetting processes and methods of measuring steam heatsetting shrinkage are disclosed in U.S. Pat. No. 6,132,839 issued to Reader and assigned to BASF Corporation (Mt. Olive, N.J.), the disclosure of which is hereby incorporated by reference in its entirety.

III. Dyes

The above-described fibers of the present invention may be dyed with one or more cationic dyes, alone or in combination with non-cationic dyes, to achieve superior dye leveling. As used herein, the term "cationic dye" is used interchangeably with the term "basic dye." The polyamide fibers may be dyed prior to incorporation into a fabric or carpet, such as with skein dyeing, or the fibers may be dyed after incorporation into a fabric or carpet. Although a variety of cationic dyes are envisioned for use in the present invention, superior dye levelness may be obtained from the use of one or more specific cationic dyes described below.

A. Cationic Dyes

Desirably, the polyamide fiber is dyed using one or more cationic dyes selected from, but not limited to, Basic Yellow 45, Basic Red 17, and Basic Blue 21. It has been discovered that the use of one or more cationic dyes selected from Basic Yellow 45, Basic Red 17, and Basic Blue 21, in combination with the polyamide fiber described above, results in a dyed polyamide fiber having superior dye levelness. The amount of each cationic dye may vary depending on the particular color and shade desired.

The amount of each cationic dye (i.e., Basic Yellow 45, Basic Red 17, and Basic Blue 21) in a given dye formulation may vary from 0 to 100 percent by weight (pbw) based on a total amount of dye used to produce the dyed polyamide fiber of the present invention. Typically, the dye formulations of the present invention comprise up to about 15.0% owf Basic Yellow 45, up to about 15.0% owf Basic Red 17, and up to about 15.0% owf Basic Blue 21. More typically, the dye formulations of the present invention comprise from 0 to about 1.0% owf Basic Yellow 45, from 0 to about 1.0% owf Basic Red 17, and from 0 to about 1.0% owf Basic Blue 21. Even more typically, the dye formulations of the present invention comprise from 0 to about 0.5% owf Basic Yellow 45, from 0 to about 0.5% owf Basic Red 17, and from 0 to about 0.5% owf Basic Blue 21.

In one embodiment of the present invention, a suitable dye formulation for producing a gray fiber comprises from about 0.003% to about 0.007% owf Basic Yellow 45, from about 0.003% to about 0.007% owf Basic Red 17, and from about 0.003% to about 0.007% owf Basic Blue 21. In a further embodiment of the present invention, a suitable dye formulation for producing a tan fiber comprises from about 0.005% to about 0.009% owf Basic Yellow 45, from about 0.0005% to about 0.0045% owf Basic Red 17, and from about 0.006% to about 0.010% owf basic Blue 21.

In a further embodiment of the present invention, the amount of Basic Yellow 45, Basic Red 17, Basic Blue 21, or any combination thereof, used to dye a given sheath/core fiber as described above varies from about 0.0005% to about 15.00% owf. The amount of Basic Yellow 45, Basic Red 17, Basic Blue 21, or any combination thereof, may vary when dyeing a sheath/core fiber as described depending on the desired color of the dyed fiber. Some examples of suitable dye combinations are given in Table 1 below:

TABLE 1

Sample Dye Formulations for Dyeing BASF's Cationic Sheath/Core Fiber a Given Color

| | Color>>> | | |
|---|---|---|---|
| | Brown % owf | Green % owf | Red % owf |
| Basic Yellow 45 | 0.015 | 0.020 | 0.008 |
| Basic Red 17 | 0.030 | 0.005 | 0.050 |
| Basic Blue 21 | 0.100 | 0.050 | 0.025 |

B. Secondary Cationic Dyes and Other Dyes

The above cationic dyes may be used alone or in combination with one or more other dyes. Suitable other dyes include, but are not limited to, secondary cationic dyes, acid dyes, and disperse dyes. Suitable secondary cationic dyes for use in the present invention include, but are not limited to, Basic Yellow 15, Basic Yellow 13, Basic Blue 47, Maxilon Blue RGL Liquid 50, and Basic Red 18:1. Suitable acid dyes for use in the present invention include, but are not limited to, Acid Yellow 199, Acid Orange 156, Acid Red 361, Acid Blue 324, and Acid Blue 277. Suitable disperse dyes for use in the present invention include, but are not limited to, Disperse Yellow 3, Disperse Red 55:1, and Disperse Blue 7.

When used in combination with other non-cationic dyes, it is desirable for the Basic Yellow 45, Basic Red 17, and/or Basic Blue 21 to be present in a total cationic dye amount, which is optimally less than about 50 pbw of a total dye amount. In one embodiment of the present invention, a suitable dye formulation comprises (1) from about 0 to about 50 pbw of one or more dyes selected from Basic Yellow 45, Basic Red 17 and Basic Blue 21, and (2) from about 50 to about 0 pbw of other non-cationic dyes, based on 100 pbw of a total dye amount.

TABLE 2

Sample Dye Formulations for Dyeing A Combination of BASF's Cationic Sheath/Core Fiber and BASF's Acid Sheath/Core Fiber

| | Cationic Sheath/Core Fiber Color>>> | |
|---|---|---|
| | Green | Gold |
| | Acid Sheath/Core Fiber Color>>> | |
| | Blue % owf | Red % owf |
| Basic Yellow 45 (100%) | 0.013 | 0.025 |
| Basic Red 17 (100%) | 0.002 | 0.009 |
| Basic Blue 21 (100%) | 0.030 | 0.050 |
| Acid Orange 156 (200%) | 0.030 | 0.120 |
| Acid Red 361 (200%) | 0.025 | 0.200 |
| Acid Blue 324 (200%) | 0.200 | 0.150 |

When Basic Yellow 45, Basic Red 17, and/or Basic Blue 21 are used in combination with other non-cationic dyes, it is desirable for the total amount of dye used to dye a given sheath/core fiber to be from about 0.0005% to about 15.00% owf.

IV. Methods of Dyeing

The sheath/core polyamide fibers of the present invention may be dyed using conventional dyeing procedures known in the art and at least one of Basic Yellow 45, Basic Red 17, and Basic Blue 21. The sheath/core polyamide fibers of the present invention, yarns containing the dye sheath/core polyamide fibers, fabrics containing the dye sheath/core polyamide fibers, or carpets containing the dye sheath/core polyamide fibers may be dyed in a batch or continuous process. The sheath/core polyamide fibers may be dyed prior to being incorporated into a yarn, fabric or carpet. Desirably, the sheath/core polyamide fibers of the present invention are formed into yarns and incorporated into a fabric or carpet, which is subsequently dyed in conventional dyeing equipment. An open-atmospheric dye vessel or a pressurized dyeing vessel may be used. Typically, a fabric or carpet is dyed in an open-atmospheric dye vessel, such as a Beck dye machine, using a dyeing procedure, dye bath chemicals, and one or more cationic dyes as described above.

Fabrics and carpets made from yarns of the present invention may contain acid dyeable and basic dyeable yarns either individually or in combination with one another. Typically, fabrics and carpets are dyed using a dye bath having a water to fabric (or carpet) weight ratio of from about 10:1 (i.e., 10 parts by weight of water to 1 part by weight of fabric) to about 30:1, with a desired ratio of about 20:1. The dye bath may contain one or more dye bath components including, but not limited to, a sequestrant, an anionic dye leveling agent; a basic dye leveling agent, a dye anti-precipitant, a non-ionic lubricant, and a pH adjustor. Any of the above dye bath components may be used in an amount ranging from 0 to about 5.0% owf, desirably, about 2.0% owf or less.

Commercially available sequestrants suitable for use in the present invention include, but are not limited to, ARROQUEST 2147 available from Arrow Engineering, Inc. (Dalton, Ga.) and SEQUESTRANT 300 available from MFG Chemicals, Inc. (Dalton, Ga.). Commercially available anionic dye leveling agents suitable for use in the present invention include, but are not limited to, AMLEV DFX available from American Emulsions Co., Inc. (Dalton, Ga.) and ARROSPERSE AC available from Arrow Engineering, Inc. (Dalton, Ga.). Commercially available basic dye leveling agents suitable for use in the present invention include, but are not limited to, AMLEV MLC available from American Emulsions Co., Inc. (Dalton, Ga.) and INTRALAN SALT HA available from Yorkshire Americas Co., Inc. (Dalton, Ga.). Commercially available dye anti-precipitants suitable for use in the present invention include, but are not limited to, ARROSPERSE 560N, available from Arrow Engineering, Inc. (Dalton, Ga.). Commercially available non-ionic lubricants suitable for use in the present invention include, but are not limited to, LUROTEX A-25 available from BASF Corporation (Charlotte, N.C.). Suitable pH adjusting agents suitable for use in the present invention include, but are not limited to, Monosodium Phosphate (40% liquid) available from Vulcan Performance Chemicals (Columbus, Ga.) and Trisodium Phosphate (Crystalline) available from Astaris, LLC (St. Louis, Mo.).

A number of dye procedures may be used to dye the sheath/core fibers of the present invention (or fabrics/carpets containing the same). Desirably, the sheath/core fiber or fabric containing the same is dyed at a temperature of at least 210° F. (98.9° C.) for a minimum time period of 60 minutes.

V. Uses

The dyed polyamide fibers of the present invention may be used alone or incorporated into a textile by conventional methods. Suitable textiles include, but are not limited to, yarn s, fabrics, and carpets. Desirably, the dyed polyamide fibers of the present invention are incorporated into a woven fabric, a nonwoven fabric, or a knit fabric. As used herein, the term "woven fabric" refers to a fabric comprising at least two sets of fibers or yarns, typically referred to as a warp and a weft, wherein one set of fibers or yarns is interwoven with the other set of fibers or yarns to form an angle between the sets of fibers or yarns. Typically, in a woven fabric, the weft is interwoven with the warp to form an angle of about 90° therewith. However, as used herein, "woven fabric" encompasses fabrics containing one or more warps, one or more wefts, and any interwoven angle formed between a given warp and a given weft.

As used herein, the term "nonwoven fabric" refers to a fabric that has a structure of individual fibers or filaments, which are randomly, orderly, and/or unidirectionally interlaid in a mat-like fashion. Nonwoven fabrics can be made from a variety of processes including, but not limited to, air-laid processes, wet-laid processes, hydroentangling processes, staple fiber carding and bonding, and solution spinning. Suitable nonwoven fabrics include, but are not limited to, needle-punched fabrics, spunlaced fabrics, meltblown fabrics, air-laid fabrics, wet-laid fabrics and combinations thereof.

As used herein, the terms "needle-punched" and "needled" refer to a web of material comprising one or more fibrous materials, wherein the fibers are subjected to needles, which entangle the fibers to achieve mechanical interlocking without the need for adhesives or chemical additives.

As used herein, the term "knitted fabric" refers to fabrics formed by knitting or on a knitting machine, wherein fibers or yarns are interlooped with one another. The term "knitted fabric" as used herein has its customary meaning.

The dyed polyamide fibers of the present invention may be used alone to form a textile, or may be combined with one or more additional fibrous materials to form a textile. Suitable additional fibrous materials for use in forming fabrics of the present invention include, but are not limited to, synthetic fibers such as those derived from polyolefins, polyesters, polyamides, polyacrylics, aramids, melamine resins, polybenzimidazole (PBI), anti-static materials, rayon, etc., alone or in combination with one another. Other suitable fibers may include, but are not limited to, natural fibers such as cotton, wool, etc. Blends of one or more of the above additional fibers with the dyed polyamide fiber of the present invention may also be used if so desired.

Desirably, the dyed polyamide fiber of the present invention is used to form woven fabrics. More desirably, the dyed polyamide fiber of the present invention is used as a pile component in carpet. Typically, the polyamide fiber of the present invention is formed into a yarn by conventional techniques described above, and then dyed prior to or after being incorporated into the carpet. Carpet may be made from a yarn by conventional carpet making techniques like weaving or tufting face (i.e., pile) yarns into a backing material and binding the face yarn to the backing with latex or other adhesives. The carpet may be cut-pile, Berber, multilevel loop, level loop, cut-pile/loop combination, or any other style. If it is desired, the carpet of the present invention may be in the form of carpet tiles or mats. As an example, in the case of cut-pile carpeting, the yarn is tufted into a primary backing and the loops are cut to form cut-pile carpeting. The primary backing may be a woven or non-woven substrate and comprised of materials including, but not limited to, nylon, polyester, polypropylene, etc. The cut-pile carpeting may be dyed to the desired shade. A secondary backing, if desired, may be adhered to the non-pile side, typically using a latex-based adhesive. The secondary backing may be composed of materials including, but not limited to, jute, polypropylene, nylon, polyester, etc.

The carpet of the present invention may be foam backed or not. The carpet of the present invention can be a variety of pile weights, pile heights and styles. There is not currently believed to be any limitation on the carpet style.

VI. Dye Levelness and Colorfastness of Dyed Products

The dyed polyamide fibers of the present invention may be incorporated into woven fabrics and carpets as described above. The dyed fabrics and carpets of the present invention have excellent dye levelness and colorfastness properties compared to dyed fabrics and carpets using cationic dyes other than Basic Yellow 45, Basic Red 17, or Basic Blue 21.

The degree of dye levelness of the dyed fabrics and carpets of the present invention is measured visually using a scale of 1 to 8. Swatches of fabric or carpet are cut, placed on a level surface, and inspected under "Day Light" light source from Macbeth Spectralight. A number of swatches are inspected and an average dye levelness value is assigned to the set of swatches. A scale of 1 (poor dye levelness) to 8 (superior dye levelness) is used. Values of 5 or less on a scale of 1 to 8 are considered unacceptable for dye levelness and uniformity in the carpet industry.

The dyed fabrics and carpets of the present invention consistently have a dye levelness value of greater than 6 as measured using the visual inspection test method described above. Typically, the dyed fabrics and carpets of the present invention have a dye levelness value of greater than 7. Even more typically, the dyed fabrics and carpets of the present invention have a dye levelness value of 8.

The colorfastness of the dyed fabrics and carpets of the present invention is measured using one of two tests. Colorfastness to ozone is measured using AATCC Test No. 129, while colorfastness to $NO_2$ is measured using AATCC Test No. 164. Both tests are a visual inspection of swatches of the fabric or carpet after exposure to ozone or $NO_2$ using one or more cycles as described in the AATCC test method. A scale of 1.0 to 5.0 is used for both tests with values usually given in multiples of 0.5.

The dyed fabrics and carpets of the present invention consistently have a colorfastness value of greater than 3.5 after four cycles as measured using test method AATCC Test No. 129 or test method AATCC Test No. 164. Typically, the dyed fabrics and carpets of the present invention have a colorfastness value of greater than 4.0 after four cycles as measured using test method AATCC Test No. 129 or test method AATCC Test No. 164. More typically, the dyed fabrics and carpets of the present invention have a colorfastness value of greater than 4.5 after four cycles as measured using test method AATCC Test No. 129 or test method AATCC Test No. 164. Even more typically, the dyed fabrics and carpets of the present invention have a colorfastness value of 5.0 after four cycles as measured using test method AATCC Test No. 129 or test method AATCC Test No. 164.

The present invention is described above and further illustrated below by way of examples, which are not to be construed in any way as imposing limitations upon the scope of the invention. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLE 1

Preparation of Dyed Carpet Using Polyamide Fibers and Cationic Dyes of the Present Invention A 100% nylon 6 ("N6") (from cationic dyeable nylon 6 chip available from BASF Corporation, Mt. Olive, N.J.) yarn is spun in a one-step spin-draw-texture ("SDT") process. The polymer temperature is 267° C. Two extruders are used. One extruder supplies the nylon 6 polymer as a core component to a bicomponent spin pack. The second extruder supplies the sheath polymer. The sheath polymer is metered at from about 3.0% to 10% by weight of the nylon fed to the spin pack. A spin pack using the principles described in U.S. Pat. No. 5,344,297 to Hills is used to produce a sheath-core trilobal fiber. The draw ratio is about 3. The filaments are combined to form a 58 filament 1250 denier yarn.

The yarn was incorporated into a carpet having a straight line, 10th gauge loop construction using a ¼ inch pile height and having 10 stitches per inch. The polyamide yarn was tufted into a polypropylene primary base substrate and the overall weight of the resulting carpet was 32 oz/yd$^2$.

The carpet substrate was fed into a VENANGO Atmospheric sample dye Beck, Serial No. OPR571078. The dye vessel was filled with water to obtain a 20:1 ratio of water weight to fabric weight. At room temperature (70° F.), the following dye bath components were added to the dye vessel:

0.5% sequestering agent (ARROQUEST 2147)[1]

0.5% anionic leveling agent (AMLEV DFX)[2]

1.0% cationic leveling agent (AMLEV MLC)[3]

2.0% nonionic lubricant (LUROTEX A-25)[4]

0.5% dye antiprecipitant (ARROSPERSE 560N)[5]

[1] Arrow Engineering, Inc. (Dalton, Ga.)

[2] American Emulsions Co., Inc. (Dalton, Ga.)

[3] American Emulsions Co., Inc. (Dalton, Ga.)

[4] BASF Corporation (Charlotte, N.C.)

[5] Arrow Engineering, Inc. (Dalton, Ga.)

The pH of the dye bath was adjusted to 6.5 using both Monosodium Phosphate (40% liquid) available from Vulcan Performance Chemicals (Columbus, Ga.) and Trisodium Phosphate (Crystalline) available from Astaris, LLC (St. Louis, Mo.).

The dye vessel was run for 10 minutes at 70° F. The following dyes were added to the dye bath:

0.025% owf Basic Yellow 45 (MAXILON YELLOW GL)[6]

0.009% owf Basic Red 17 (SEVRON RED LMF)[7]

0.050% owf Basic Blue 21 (SEVRON BLUE B)[8]

[6] CIBA Specialty Chemicals (Dalton, Ga.)

[7] Yorkshire Americas, Inc. (Dalton, Ga.)

[8] Yorkshire Americas, Inc. (Dalton, Ga.)

The dye bath was heated to 145° F. at a heating rate of 3° F. per minute, and then heated to 210° F. at a heating rate of 2° F. per minute. The dye bath was held at 210° F. for 60 minutes. The dye bath was then cooled at a cooling rate of 5° F. per minute. The dyed carpet substrate was then rinsed and removed from the dye vessel.

The resulting carpet substrate exhibited a visual dye levelness/uniformity rating of "8" on a scale of 1 to 8 (i.e., the carpet had superior dye levelness properties). In addition, the resulting carpet substrate exhibited a rating of 3.5 after 4 cycles for both AATCC Test Nos. 129 and 164.

COMPARATIVE EXAMPLE 2

Preparation of Dyed Carpet Using Polyamide Fibers and Other Cationic Dyes

The dyeing procedure of Example 1 was repeated except the following dyes were used:

0.020% owf Basic Yellow 53 (SEVRON YELLOW 8GMF)[9]

0.007% owf Basic Red 73 (SEVRON RED YCN)[10]

0.022% owf Basic Blue 94 (SEVRON BLUE NCN)[11]

[9] Yorkshire Americas, Inc. (Dalton, Ga.)

[10] Yorkshire Americas, Inc. (Dalton, Ga.)

[11] Yorkshire Americas, Inc. (Dalton, Ga.)

The resulting carpet substrate exhibited a visual dye levelness/uniformity rating of "1" on a scale of 1 to 8 (i.e., the carpet had unacceptable dye levelness properties).

As shown by Example 1 and Comparative Example 2, the specific combination of polyamide yarn and cationic dyes of the present invention greatly improves the dye levelness of the resulting dyed fabric.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A dyed fiber comprising:

a core fiber component comprising a basic-dyeable polyamide or copolyamide;

a sheath fiber component covering at least a portion of the core fiber component, wherein the sheath fiber component comprises a fiber-forming non-dyeable polymer that resists dye migration at room temperature; and a cationic dye mixture chemically bonded to the core fiber component, wherein the cationic dye mixture consists essentially of a combination of Basic Yellow 45, Basic Red 17, and Basic Blue 21.

2. The dyed fiber of claim 1, wherein the sheath fiber component comprises a non-dyeable fiber-forming polymer selected from polyolefin, fiber-forming polystyrene, fiber-forming polyurethane, and polyamide.

3. The dyed fiber of claim 2, wherein the sheath fiber component comprises a polyamide having polymeric structural units selected from:

$$[—NH—(CH_2)_x—NH—C(O)—(CH_2)_y—C(O)—]_n \quad (a)$$

wherein x and y are each independently an integer, and n is greater than 40;

$$[—NH—(CH_2)_z—C(O)—]_m \quad (b)$$

where z is an integer, and m is greater than 40;

(c) polymers of (a) or (b) having substituted thereon one or more sulfonate, halogenate, aliphatic or aromatic moieties; and (d) copolymers formed from at least two polymeric structural units of (a), (b) and (c); and (e) blends of at least two polymers of (a), (b) and (c).

4. The dyed fiber of claim 3, wherein x and y are each independently from about 4 to about 30, and a sum of x and y is greater than about 8; and z is from about 9 to about 30.

5. The dyed fiber of claim 4, wherein each of (a) the sum of x and y, and (b) z are independently from about 9 to about 20.

6. The dyed fiber of claim 5, wherein (a) the sum of x and y is from about 9 to about 18, and (b) z is from about 9 to about 15.

7. The dyed fiber of claim 1, wherein the core fiber component comprises a polymer having a polymer backbone chain of recurring amide groups (—CO—NR—), wherein R is an alkyl, aryl, alkenyl, or alkynyl moiety, substituted with sulfonate moieties.

8. The dyed fiber of claim 1, wherein the core fiber component comprises a sulfonate-containing polyamide having 15 or less carbon atoms in a repeating unit.

9. The dyed fiber of claim 1, wherein the core fiber component comprises a sulfonate-containing polyamide having 7 or less carbon atoms in a repeating unit.

10. The dyed fiber of claim 1, wherein the core fiber component comprises a sulfonate-containing nylon 6.

11. The dyed fiber of claim 1, wherein the sheath fiber component comprises a polymer which is substantially free of polar substituents including hydroxy, amino, sulfoxyl, carboxyl, nitroxyl, or any other moiety capable of hydrogen-bonding.

12. The dyed fiber of claim 1, wherein the cationic dye mixture further consists essentially of one or more secondary cationic dyes chemically bonded to the core fiber component, wherein the one or more secondary cationic dyes comprise Basic Yellow 15, Basic Yellow 13, Basic Blue 47, Basic Red 18:1, or a combination thereof.

13. A yarn comprising the dyed fiber of claim 1.

14. A fabric comprising the yarn of claim 13.

15. A carpet comprising the yarn of claim 13.

16. A dyed fiber comprising:

(i) a core fiber component comprising a basic-dyeable polyamide or copolyamide;

(ii) a sheath fiber component covering at least a portion of the core fiber component, wherein the sheath fiber component comprises a polyamide having polymeric structural units selected from:

$$[—NH—(CH_2)_x—NH—C(O)—(CH_2)_y—C(O)—]_n \quad (a)$$

wherein x and y are each independently an integer, and n is greater than 40;

$$[—NH—(CH_2)_z—C(O)—]_m \quad (b)$$

where z is an integer, and m is greater than 40;

(c) polymers of (a) or (b) having substituted thereon one or more sulfonate, halogenate, aliphatic or aromatic moieties; and (d) copolymers formed from at least two polymeric structural units of (a), (b) and (c); and (e) blends of at least two polymers of (a), (b) and (c); and (iii) a cationic dye mixture chemically bonded to the core fiber component, wherein the cationic dye mixture consists essentially of a combination of Basic Yellow 45, Basic Red 17, Basic Blue 21.

17. A method of making a dyed fiber, said method comprising:

chemically bonding a mixture of cationic dyes to a core of a sheath/core fiber having a core fiber component comprising a basic-dyeable polyamide or copolyamide, and a sheath fiber component covering at least a portion of the core fiber component, wherein the sheath fiber component comprises a non-dyeable fiber-forming polymer that resists dye migration at room temperature;

wherein the mixture of cationic dyes consists essentially of Basic Yellow 45, Basic Red 17, and Basic Blue 21.

18. The method of claim 17, wherein the sheath fiber component comprises a non-dyeable fiber-forming polymer selected from polyolefin, fiber-forming polystyrene, fiber-forming polyurethane, and polyamide.

19. The method of claim 17, wherein the sheath fiber component comprises a polyamide having polymeric structural units selected from:

$$[—NH—(CH_2)_x—NH—C(O)—(CH_2)_y—C(O)—]_n \quad (a)$$

wherein x and y are each independently an integer, and n is greater than 40;

$$[—NH—(CH_2)_z—C(O)—]_m \quad (b)$$

where z is an integer, and m is greater than 40;

(c) polymers of (a) or (b) having substituted thereon one or more sulfonate, halogenate, aliphatic or aromatic moieties; and (d) copolymers formed from at least two polymeric structural units of (a), (b) and (c); and (e) blends of at least two polymers of (a), (b) and (c).

20. The method of claim 19, wherein x and y are each independently from about 4 to about 30, and a sum of x and y is greater than about 8; and z is from about 9 to about 30.

21. The method of claim 20, wherein each of (a) the sum of x and y, and (b) z are independently from about 9 to about 20.

22. The method of claim 21, wherein (a) the sum of x and y is from about 9 to about 18, and (b) z is from about 9 to about 15.

23. The method of claim 17, wherein the core fiber component comprises a polymer having a polymer backbone chain of recurring amide groups (—CO—NR—), wherein R is an alkyl, aryl, alkenyl, or alkynyl moiety, substituted with sulfonate moieties.

24. A dyed fiber comprising:

a core fiber component comprising a sulphonated basic-dyeable nylon 6 or nylon 6/6 polymer;

a sheath fiber component covering at least a portion of the core fiber component, wherein the sheath fiber component comprises a fiber-forming suiphonate-free nylon 6/12 polymer that resists dye migration at room temperature; and a cationic dye mixture chemically bonded to the core fiber component, wherein the cationic dye mixture consists essentially of a combination of Basic Yellow 45, Basic Red 17, and Basic Blue 21, and wherein the dyed fiber has a dye levelness of greater than 6.

25. A method of making a dyed fiber comprising the steps of:

(a) providing a dye bath containing a mixture of cationic dyes consisting essentially of Basic Yellow 45, Basic Red 17, and Basic Blue 21;

(b) bringing into contact with the dye bath an undyed fiber having a core fiber component comprising a sulphonated basic-dyeable nylon 6 or nylon 6/6 polymer, and a sheath fiber component covering at least a portion of the core fiber component which comprises a fiber-forming sulphonate-free nylon 6/12 polymer that resists dye migration at room temperature; and (c) maintaining the fiber in contact with the dye bath at a dye bath temperature of at least 210° F. and for a minimum time period of 60 minutes to thereby allow the one or more cationic dyes in the dye bath to be chemically bonded to the core fiber component and obtain a dyed fiber having a dye levelness of greater than 6.

26. The method of claim 25, wherein the dye bath further contains at least one or more secondary cationic dyes comprising Basic Yellow 15, Basic Yellow 13, Basic Blue 47, Basic Red 18:1, or a combination thereof.

27. The method of claim 25 or 26, wherein the dye bath contains at least one other dye bath component selected from sequestering agents, leveling agents, lubricants and dye antiprecipitants.

28. The method of claim 25 or 26, wherein the dye bath contains a sequestering agent, an anionic leveling agent, a cationic leveling agent, a nonionic lubricant, and a dye antiprecipitant.

* * * * *

UNITED STATES PATENT AND TRADEMARK OFFICE

CERTIFICATE OF CORRECTION

PATENT NO. : 7,033,669 B2
APPLICATION NO. : 10/360669
DATED : April 25, 2006
INVENTOR(S) : Ronald O. Skidds It is certified that error appears in the above-identified patent and that said Letters Patent is hereby corrected as shown below:

Title Page, item [73] left column,

Add

[73] Assignee: HONEYWELL INTERNATIONAL INC., Morristown, New Jersey

Signed and Sealed this

Nineteenth Day of February, 2008

JON W. DUDAS
*Director of the United States Patent and Trademark Office*